US007437121B2

(12) United States Patent
Itoh et al.

(10) Patent No.: US 7,437,121 B2
(45) Date of Patent: Oct. 14, 2008

(54) METHOD AND APPARATUS FOR RECEIVING BROADCAST PROGRAMS AND DETECTING A CHANGE IN PROGRAM INFORMATION

(75) Inventors: Tomoaki Itoh, Kawasaki (JP); Takao Yamaguchi, Machida (JP); Ichiro Takei, Suginami-ku (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 757 days.

(21) Appl. No.: 10/495,685

(22) PCT Filed: Mar. 20, 2003

(86) PCT No.: PCT/JP03/03410

§ 371 (c)(1),
(2), (4) Date: May 14, 2004

(87) PCT Pub. No.: WO03/081816

PCT Pub. Date: Oct. 2, 2003

(65) Prior Publication Data

US 2004/0259495 A1 Dec. 23, 2004

(30) Foreign Application Priority Data

Mar. 22, 2002 (JP) ..... 2002-080343
Feb. 17, 2003 (JP) ..... 2003-037888

(51) Int. Cl.
*H04H 20/71* (2008.01)

(52) U.S. Cl. ..... 455/3.01; 455/525; 455/3.02; 455/438; 455/67.11; 370/331; 370/345

(58) Field of Classification Search ..... 455/3.01, 455/525, 3.02, 436, 67.11; 370/331, 345
See application file for complete search history.

(56) References Cited

U.S. PATENT DOCUMENTS 5,263,177 A 11/1993 Schieve et al.

(Continued)

FOREIGN PATENT DOCUMENTS

EP 0 720 317 A1 7/1996

(Continued)

OTHER PUBLICATIONS

English translation of International Search Report for PCT/JP03/03410, dated Jul. 17, 2003.

*Primary Examiner*—Sanh D Phu
(74) *Attorney, Agent, or Firm*—RatnerPrestia

(57) ABSTRACT

There is provided a transmitting section for receiving program information representative of an outline and receiving condition of a receivable program and further receiving a program on the basis of the program information, and a zone-change determining section for detecting a change of the program information. The program selecting section causes the transmitting section to suspend program reception and to switch a communication port, on the basis of a determination of a change of program distribution area by the zone-change determining section. Due to this, the transmitting section is allowed to continuously receive the program so far received. This, in the case a program is provided at a communication port different based on each region, makes it possible to correctly receive a program even if moving traversing a region.

10 Claims, 10 Drawing Sheets

U.S. PATENT DOCUMENTS

| | | | | |
|---|---|---|---|---|
| 6,577,617 | B1 * | 6/2003 | Ue et al. | 370/347 |
| 6,614,770 | B1 * | 9/2003 | Kayama et al. | 370/331 |
| 6,618,585 | B1 * | 9/2003 | Robinson | 455/3.02 |
| 6,804,510 | B1 * | 10/2004 | Bates et al. | 455/414.4 |
| 2004/0100937 | A1 * | 5/2004 | Chen | 370/345 |
| 2005/0085182 | A1 * | 4/2005 | Chuberre et al. | 455/3.01 |

FOREIGN PATENT DOCUMENTS

| | | | |
|---|---|---|---|
| EP | 0 930 594 | A | 7/1999 |
| EP | 0 944 275 | A2 | 9/1999 |
| EP | 0 944 275 | A3 | 9/1999 |
| EP | 1022915 | A | 7/2000 |
| JP | 03-222590 | | 10/1991 |
| JP | 2001-111504 | A | 4/2001 |
| JP | 2002-009649 | A | 1/2002 |
| WO | WO 99/62254 | | 12/1999 |
| WO | WO 02/19748 | A1 | 3/2002 |

* cited by examiner

METHOD AND APPARATUS FOR RECEIVING BROADCAST PROGRAMS AND DETECTING A CHANGE IN PROGRAM INFORMATION

This Application is a U.S. National Phase Application of PCT International Application PCT/JP03/03410.

TECHNICAL FIELD

The present invention relates to a media receiving method and media receiver for the mobiles to receive contents by the use of a communication network or broadcast network.

BACKGROUND ART

In the traditional terrestrial-wave broadcast, where receiving a program during movement, the movement if beyond an outside of a radio-wave receivable range makes impossible to receive the program or browse the program. As a media receiver for preventing this, there is a description in Patent Document 1, for example. FIG. 9 is a diagram showing a configuration of a conventional media receiver described in JP-A-03-222590.

In FIG. 9, a character-broadcast extracting section 903 extracts a character-broadcast signal from a television broadcast signal received at an antenna 901, and detects a program index data head contained in this signal. Out of it a transmission identification number is read, on the basis of which data a synthesizer tuner 902 is set by an area, a broadcast station and a channel that are determined from an SID broadcast table 904. Due to this, when there is deterioration in the radio wave, channels are scanned over to detect a station in the same series, thus enabling smooth switching the channel.

However, usually, in the case of realizing a broadcast on a network by using a communication network like cellular telephone, the base stations are arranged with overlap in a range the radio wave reaches from the base station such that there is no deterioration in the state of the radio wave the cellular phones are to receive. The reception terminal unit is to access a base station that is the highest in signal reception level of among a plurality of base stations. Consequently, in the conventional configuration, radio wave reception state always does not deteriorate worse than a constant value excepting the case of outside a reception area. Accordingly, it is impossible for the reception terminal unit to detect a worsened state of radio wave and start channel scanning.

Meanwhile, in the program distributing area the reception terminal has moved, the broadcast station not necessarily sends a program onto the same channel as that of before movement.

Consequently, in the case of a system the reception terminal unit receives a program based on program information, even if the reception terminal unit moves the program distribution area, it continues to receive the program based on the program information before movement. There has been a problem that reception be started for another program than a program to be desirably viewed. Incidentally, the program information describes information representative of what program is sent over which channel, e.g. program start time, end time, program outline and channel for program reception.

DISCLOSURE OF THE INVENTION

It is an object of the present invention to provide a media receiving method that, where a program is distributed at a channel different based on each region, it is possible to correctly receive a program even if a media receiver moves the regions.

A media receiving method according to the present invention comprises: a step of receiving program information representative of an outline and receiving condition of a receivable program; a step of receiving and reproducing a program on the basis of the program information; a step of detecting that the program information has changed; and a step of determining whether a program is allowed for reproduction or not, on the basis of the change of program information.

Due to this, even if receiving a program different from the program having viewed when moving between the program distribution areas, the program is not reproduced. Accordingly, it is possible to prevent against continuous outputting, such as displaying, of a program the user does not desire.

Also, whether a program is allowed for reproduction or not is for reproduction in a case that a communication port for a program having been received before the change of program information is the same as that of after the change, and not for reproduction in a case not the same as that.

Due to this, when there is change in reception port of a program, the program is not reproduced. Accordingly, it is possible to prevent against continuous outputting, such as displaying, of a program the user does not desire.

Also, further comprised is a step that, in a case of not allowed for reproduction, when there is difference in communication port but there is a same one as the program, switching is made to the communication port of after the change while, when there is not a same one as the program, reception is suspended.

Due to this, when moving between the program distribution areas, the communication port for a program having so far viewed is automatically switched. Accordingly, it is possible to continuously output, such as by displaying, a program.

Also, a media receiving method according to the present invention comprises: a step of receiving program information representative of an outline and receiving condition of a receivable program; a step of receiving and reproducing a program on the basis of the program information; a base-station selecting step of measuring intensities of radio waves from a plurality of base stations, and selecting a base station to access on the basis of the radio wave intensity; a change detection step of detecting that a base station to access has changed; and a suspension step of suspending a current reception of the program on the basis of the detection of a change.

Due to this, when detecting that a new program distribution area is entered, program information is again received. Accordingly, it is possible to reduce the load for receiving program information.

Also, a step is comprised of receiving new program information after the suspension step of the media receiving method of the invention; and a step of receiving a same program as the program having been received before the suspension.

Due to this, according to the program information of a new program distribution area, a program same as a program so far received is automatically received. Accordingly, it is possible to make a continuous output, such as display.

Also, the program information in a media receiving method according to the invention is received only in a predetermined time from a change of base station.

Due to this, because the reception time period of program information is limited, it is possible to reduce the load for receiving program information.

Also, the program information in the media receiving method of the invention includes information specifying a program name, a program start time, an end time, a reception port number and a program distributing area.

Due to this, it is possible to acquire, from program information, all the pieces of information required in receiving a program to be desirably viewed.

A media receiver according to the invention comprises: a transmitting section for receiving program information representative of an outline and receiving condition of a receivable program, and further receiving a program on the basis of the program information; and a zone-change determining section for detecting a change of the program information; whereby the transmitting section suspends a reception of the program based on a determination of a change of an area where the program is to be distributed made by the zone-change determining section.

Due to this, when moving between the program distribution areas, reception is suspended. Accordingly, it is possible to continuously output, e.g. display, a program the user does not desire.

Also, a media receiver according to the invention comprises: a transmitting section for receiving program information representative of an outline and receiving condition of a receivable program, and further receiving a program on the basis of the program information; and a data reproducing section for reproducing the program; and a zone-change determining section for detecting a change of the program information; whereby, when the zone-change determining section determines a change of program distribution area, in case a communication port for a program having been received before the change is not a same as that of after the change, the data reproducing section is not allowed for reproduction.

Due to this, even if receiving a program different from a program having been viewed when moving between the program distribution areas, the program is not reproduced. Accordingly, it is possible to continuously output, e.g. display, a program the user does not desire.

Also, in a case of being not allowed for reproduction of a program in the media receiver of the invention, when there is difference in communication port but there is a same program, the transmitting section makes switching to the communication port of after the change while, when there is not a same program, the transmitting section suspends reception.

Due to this, when moving between the program distribution areas, the communication port for a program having so far viewed is automatically switched. It is possible to continuously output, e.g. display, a program.

Also, a media receiver according to the present invention comprises: a transmitting section for receiving program information representative of an outline and receiving condition of a receivable program, and further receiving a program on the basis of the program information; a data reproducing section for reproducing the program; a base-station selecting section for measuring intensities of radio waves from a plurality of base stations, and selecting a base station to access on the basis of the radio wave intensity; a zone-change detecting section for detecting that a base station to access has changed; whereby the transmitting section suspends a reception of the program based on a determination of a change of an area where the program is to be distributed made by the zone-change determining section.

Due to this, when detecting that a new program distribution area is entered, program information is again received. Accordingly, it is possible to reduce the load for receiving program information.

Also, the transmitting section of the media receiver of the invention after the suspension receives new program information, and receives a same program as a program having received before the suspension on the basis of the new program information.

Due to this, according to program information of a new program distribution area, a program same as a program so far received is automatically received. Accordingly, it is possible to continuously output, e.g. display.

Also, the transmitting section of the media receiver of the invention receives program information only in a predetermined time from a change of base station.

Due to this, because the reception time period of program information is limited, it is possible to reduce the load for receiving program information.

Also, the program information in the media receiver of the invention includes information specifying a program name, a program start time, an end time, a reception port number and a program distributing area.

Due to this, it is possible to acquire, from program information, all the pieces of information required in receiving a program to be desirably viewed.

As in the above, according to the present invention, in the case that a program is provided at a communication port different based on each region, a media receiver even if moving a region can correctly receive a program. Accordingly, even on the Internet using a communication network or broadcast network, the user is allowed to view such a broadcast as a terrestrial-wave TV broadcast.

BEST MODE FOR CARRYING OUT THE INVENTION

Hereunder, embodiments of the present invention will be explained in conjugation with the drawings.

First Exemplary Embodiment

Figure 1A:
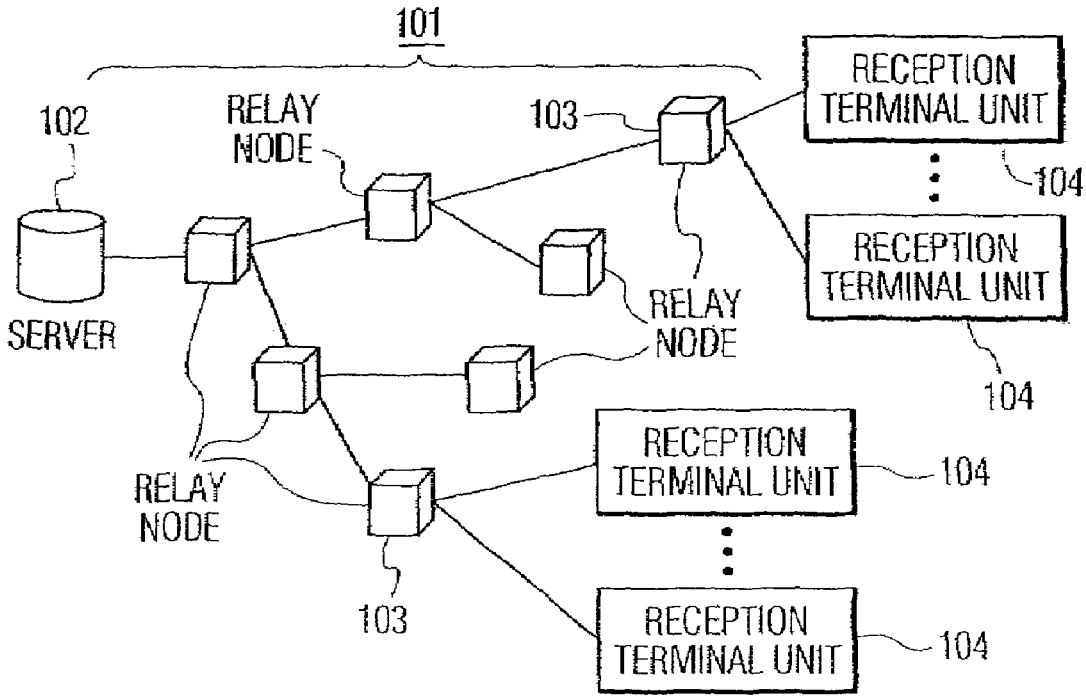
FIG. 1A is a diagram showing a utilization form of a communication network in embodiment 1 of the present invention.
Figure 1B:
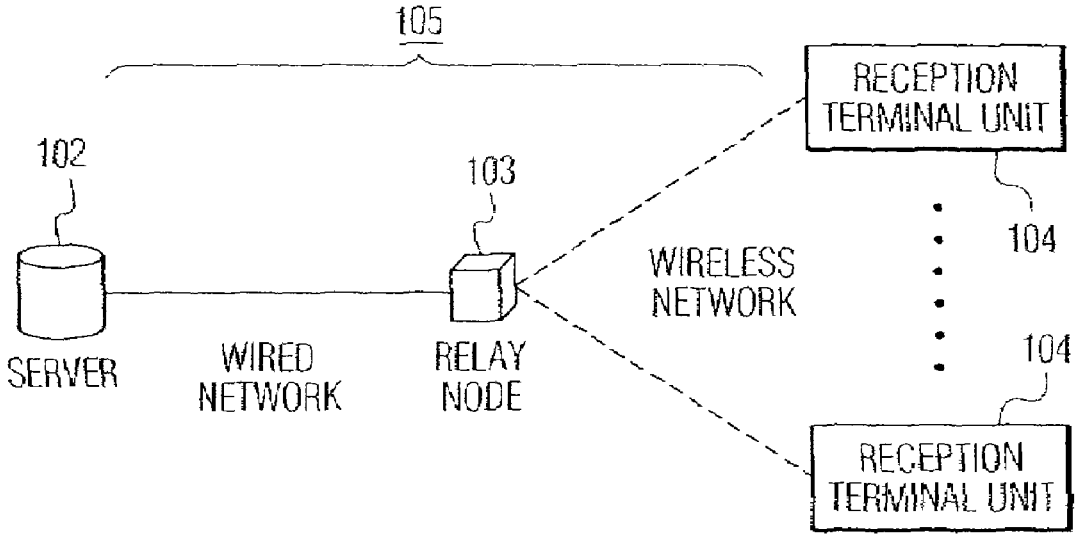
FIG. 1B is a diagram showing a utilization form of a communication network in embodiment 1 of the invention.
Figure 1C:
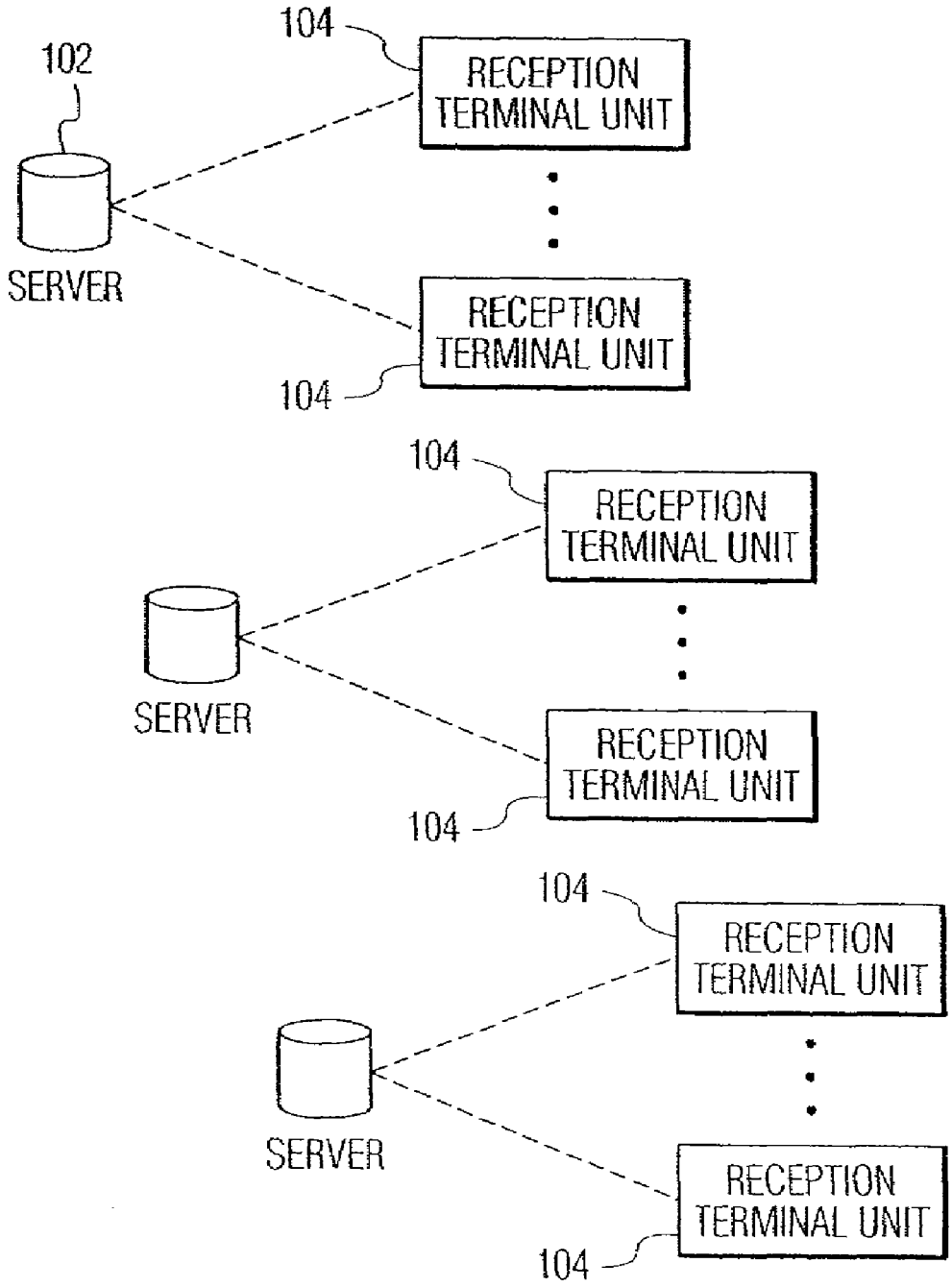
FIG. 1C is a diagram showing a utilization form of a communication network in embodiment 1 of the invention.

FIGS. 1A, 1B and 1C show a utilization form of an applicable communication network in a first embodiment of the invention.

In FIG. 1A, a network 101 the invention is applied may be a wired network (e.g. ADSL, ISDN, ATM or FTTH) or a wireless network (e.g. cellular phone or radio RAN). Otherwise, it may be a communication line 105 having wired network and wireless networks connected mutually, as shown in FIG. 1B.

The transmission protocol uses an Internet protocol, while communication apparatuses are mutually connected through relay nodes 103, such as routers and gateways (GWs). The relay node 103 has a broadcast or multicast function, so that a data packet can be duplicated in the relay node 103. Also, the content transmitting method may use 1-to-1 type communication at between the server 102 and the reception terminal unit 104. Or, a broadcast or multicast function may be employed for 1-to-N type communication.

Furthermore, as shown in FIG. 1C, the communication form may be that servers 102 exist at various locations to broadcast data to neighboring areas while reception terminal unit 104 receives the data. In such a communication form, transmission protocol may utilize a Blue Tooth, a radio LAN or the like.

The contents to be sent are various medias, including moving images, sound, music, texts, still images and layout information.

The reception terminal units 104 maybe terminals different in resolution of display or process capability, e.g. cellular phones, TV sets, PDA and personal computers. Also, the reception terminal units 104 may simultaneously receive contents from a plurality of program-distributing servers. Furthermore, the reception terminal unit 104 may have a capability of simultaneously having access to a plurality of transmission lines besides a single transmission line.

Also, the connection route between the server 102 and the reception terminal unit 104 may be of a system configuration having a broadcast network (e.g. terrestrial wave digital broadcast, satellite digital broadcast) or a combination of broadcast and communication networks, besides communication network 101. Particularly, in the case of broadcasting contents for the moving reception terminal unit such as cellular telephone, there is a demand for broadcasting contents different based on each region. However, in case broadcast or multicast is done from the server onto a plurality of reception terminal units, it is not easy to change the broadcast content suitably for the location.

In this embodiment, for realizing a broadcast suited for the location, the FIG. 1B example utilizes 1-to-1 communication at between the server 102 and the relay node 103 (wired-network section) and a broadcast function for distribution at between the relay node 103 and the reception terminal unit 104. The relay node 103 realizing the broadcast function does not broadcast packets beyond another relay node 103.

Also, from the server 102, transmitted are program information (data describing a program outline, a broadcast start/end time, a communication ports for use in broadcasting (corresponding to TV broadcast channels, specifically referring to destination IP addresses, port numbers, etc.)), program data (a moving image, sound, music, a text, a still image, a program, and layout information, e.g. SMIL, for combining and displaying these). The reception terminal unit 104 first receives the program information, and receives program data based thereon. Incidentally, program information and program data may be transmitted by utilizing the same transmission line, or transmitted utilizing separate transmission lines respectively. For example, program information may be transmitted by using a broadcast network while program data may be transmitted by using a communication line.

Figure 2:
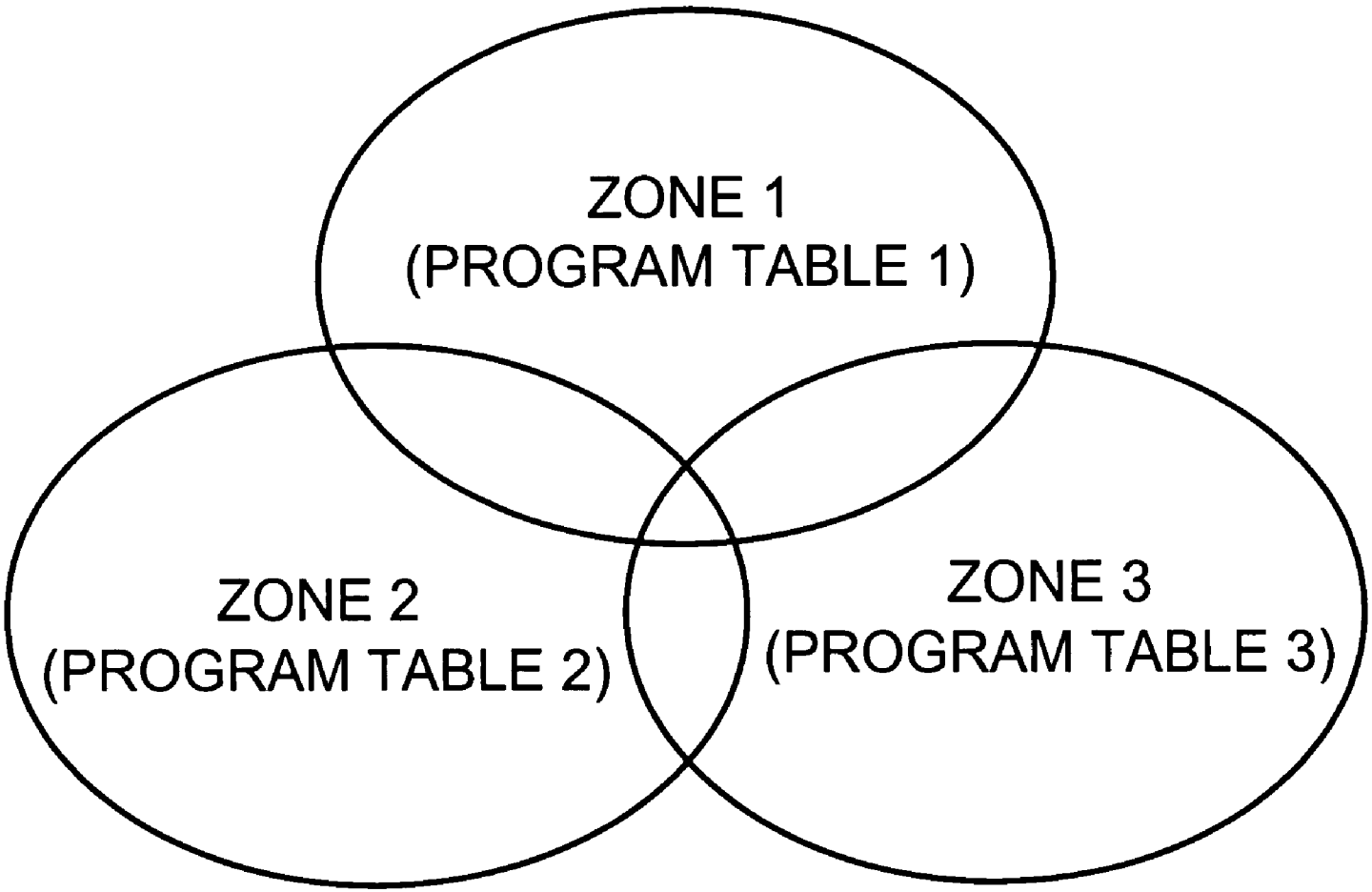
FIG. 2 is a figure showing a concept for broadcasting different programs based on each region in embodiment 1 of the invention.

FIG. 2 is a view showing a concept for broadcasting a program different based on each region.

In FIG. 2, three kinds of different programs are on the air in three regions (zones 1 to 3). Herein, the zone is a program distribution area to which a program is to be distributed. The server may broadcast quite different contents to the three regions, or may broadcast a same content in deviated time. The zone, for cellular telephone or radio LAN for example, can be given as a range in which one base station is allowed to distribute data without causing a change of the base station in access (hereinafter referred to as "handover") or, for a wired network, can be as a place name (e.g. Osaka-city, Tokyo-metropolis). Incidentally, the zone is not limited to those. Also, the distribution method of within a zone (1-to-1 communication type, broadcast type) may be different from zone to zone.

Figure 3:
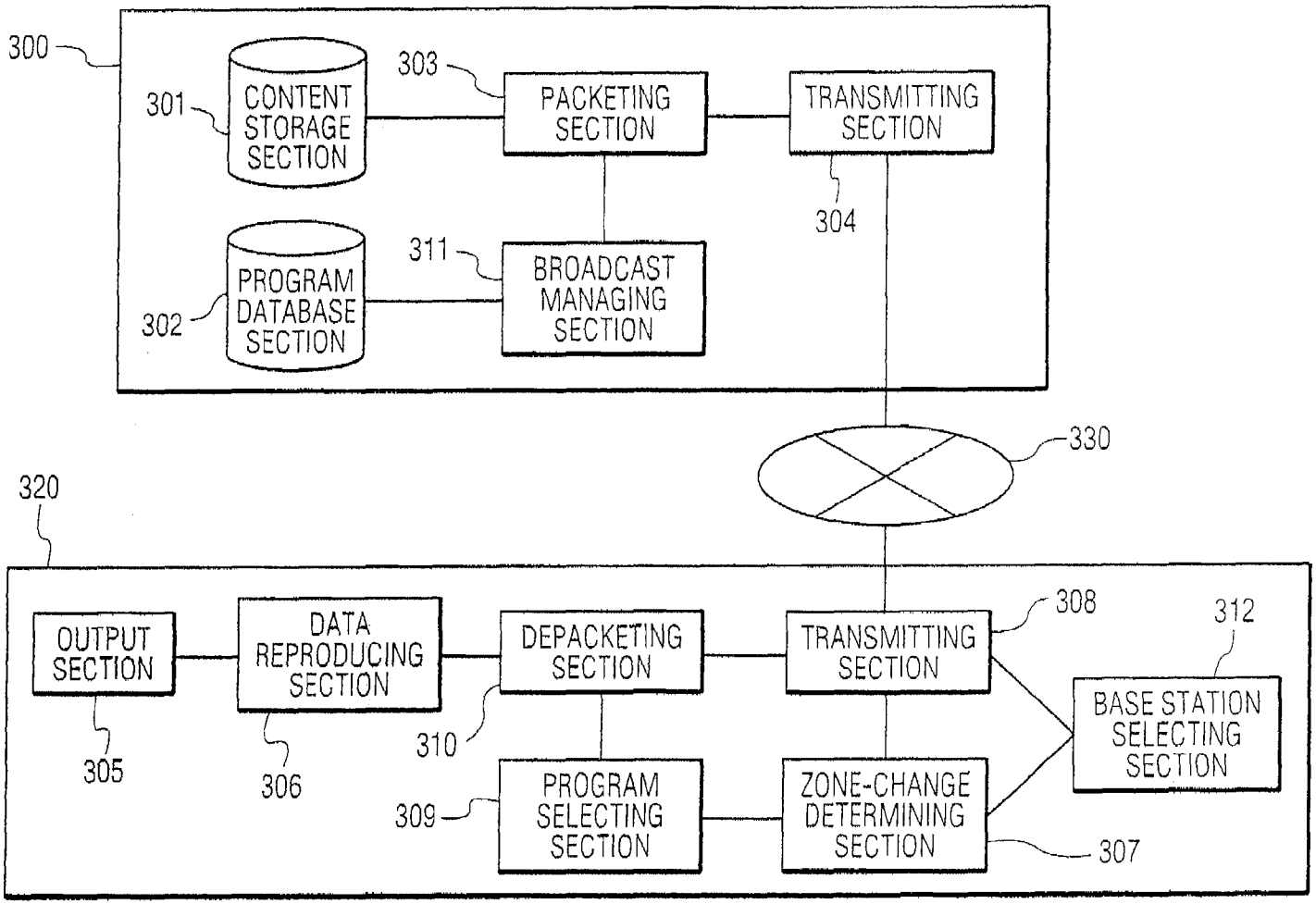
FIG. 3 is a diagram showing a configuration of a program distribution system in embodiment 1 of the invention.

FIG. 3 is a diagram showing a broadcast distribution system in a first embodiment of the invention.

In FIG. 3, a media transmitter 300 is sending program information and program data though an IP network 330.

The transmitter 300 corresponds to the server 102 shown in FIGS. 1A, 1B and 1C, which is configured with a content storage section 301, a program data base section 302, a packetizing section 303, a transmitting section 304 and a broadcast managing section 311.

The content storage section 301 carries out storage management of program data. This, specifically, is a storage medium represented by a hard disk drive HDD.

The program database section 302 manages program information.

The broadcast managing section 311 reads out the program information stored in the program database section 302. This instructs the packetizing section 303 to start a broadcast of the program when a broadcast start time of a program comes, and instructs the same to end the broadcast when an end time comes. Also, program information is forwarded to the packetizing section 303. Incidentally, the describing method of program information may use an XML or a protocol for session description, e.g. an SDP.

According to a program start instruction by the broadcast managing section 311, the packetizing section 303 takes program data out of the content storage section 301 and packets the program data and program information. The information of program data to be packetized is described in the program information. Meanwhile, the packetizing method may use a media transmission protocol, e.g. RTP/UDP/IP. Incidentally, the packetizing section 303 sets a packet-header destination with such a value as to reach a defined communication port, on the basis of the program information from the broadcast managing section 311.

The transmitting section 304 is an interface capable of sending data onto the IP network 330.

Next, a media receiver 320 will be explained in the below. Incidentally, the media receiver 320 corresponds to the reception terminal unit 104 shown in FIGS. 1A, 1B and 1C.

The media receiver 320 is configured with a transmitting section 308, a base-station selecting section 312, a depacketizing section 310, a program selecting section 309, a data reproducing section 306, an output section 305 and a zone-change determining section 307.

The transmitting section 308 is an interface for receiving data from the IP network 330, wherein the communication ports for data reception include a known communication port, for receiving program information, common to all the regions and a communication port instructed from the program selecting section 309. The transmitting section 308, forwards a received packet to the depacketizing section 310. This, also, closes and ends the reception port for a program being received on the basis of a zone-change notification from the zone-change determining section 307, and switching the communication port for receiving program data according to a notification from the base station selecting section 312.

The base station selecting section 312 measures an intensity of a radio wave of from a plurality of base stations and determines a base station highest in radio wave intensity as a base station to access. Also, this notifies an occurrence of handover to the zone-change determining section 307 and the transmitting section 308.

The depacketizing section 310 is means for taking data out of a received packet. The taken data, if program data, is forwarded to the data reproducing section 306 or, if program information, to the program selecting section 309.

The program selecting section 309 is means for selecting a program for reception out of the program information received from the depacketizing section 310. This program selecting section 309 has a contrivance for presenting a user a list of program titles and the like contained in the program information so that the user is allowed to select a desired program from the program table on display. Also, the program selecting section 309 notifies a communication port for receiving a selected program to the transmitting section 308 through the zone-change determining section 307.

The data reproducing section 306 carries out a storage/decoding process of the program data received from the depacketizing section 310. Specifically, the various medias included in the program data are decoded, and laid out in space and time on the basis of layout information.

Figure 5:
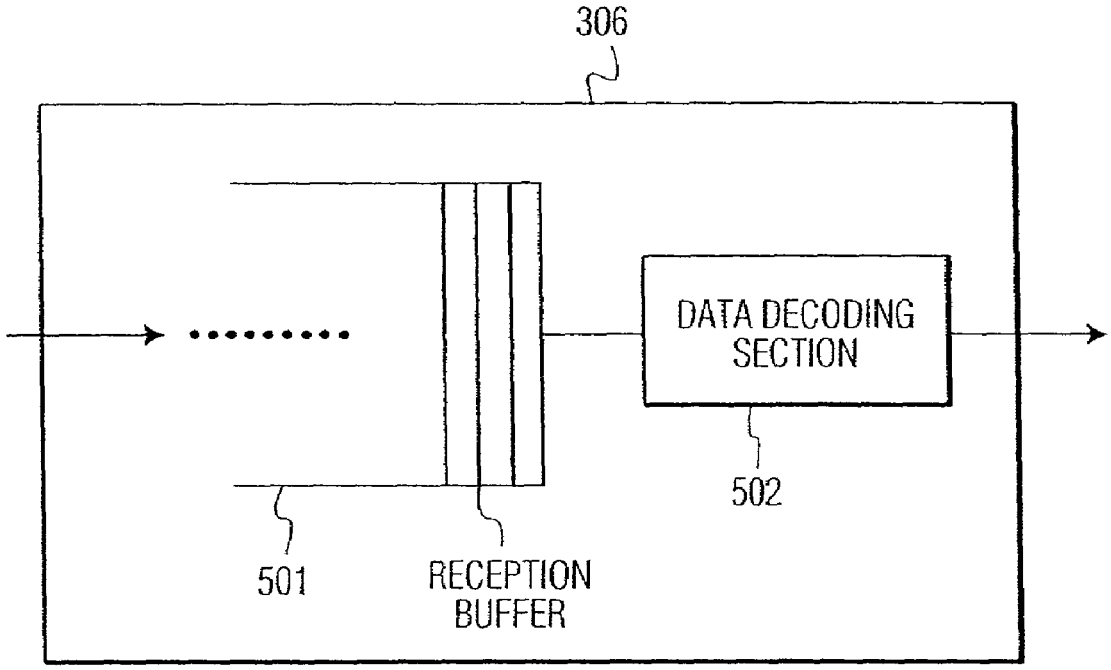
FIG. 5 is a diagram showing a configuration of a data reproducing section in embodiment 1 of the invention.

Herein, the configuration of the data reproducing section 306 will be explained by using FIG. 5.

The data reproducing section 306 is configured with a reception buffer 501 for storing received data and a data decoding section 502 for decoding the received data. The reception buffer 501 and data decoding section 502 may be separately prepared based on each data kind. For example, these are separately prepared according to a media kind or data kind, such as MPEG4 or AMR. Incidentally, in such a case, in order to deliver data to individual reception buffers, there is a need to prepare a not-shown data-kind determining section for determining a media kind or data kind. Determining a media kind or data kind can be made with a transmission protocol payload type (e.g. RTP/RTCP (IETF RFC 1889) in the case of a media transmission protocol), a communication port (e.g. to be expressed by an IP address or port number), or the like.

The output section 305 is means for presenting a user the program data of from the data reproducing section 306. The means for presentation to a user, specifically, is a video display device represented by a CRT or LCD, and a sound reproducing device such as a speaker.

The zone-change determining section 307 is means for detecting a change of zone. Determining a zone change is made by a notification of base station change given from the base-station selecting section 312. Also, the zone-change determining section 307 notifies the program selecting section 309 to update the program information, in order to invalidate the program information currently held because of entering a new zone.

Herein, explanation will be made below on the program information by using the drawings.

Figure 8:
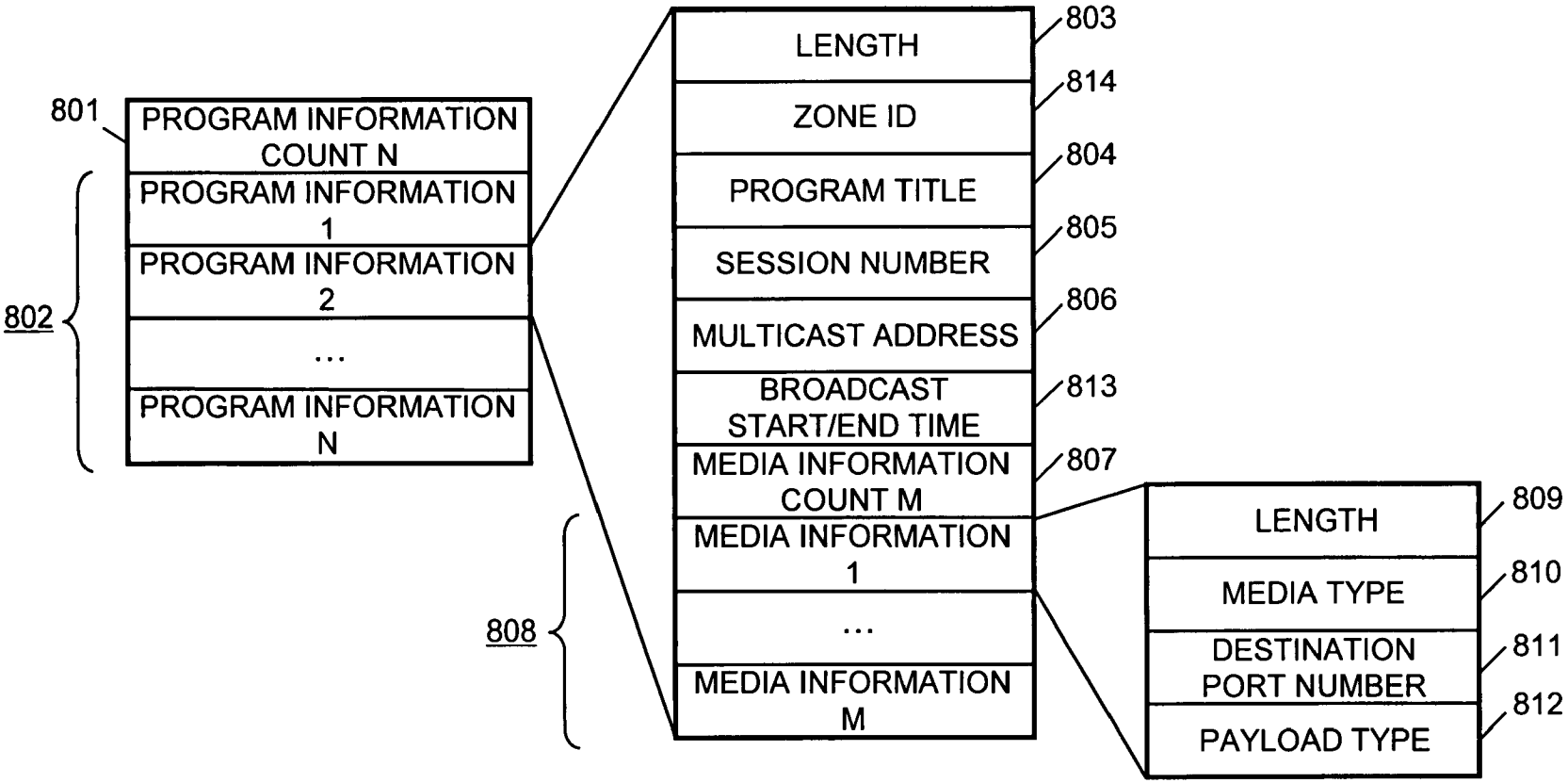
FIG. 8 is a figure showing a program information format in embodiment 1 of the invention.
Figure 9:
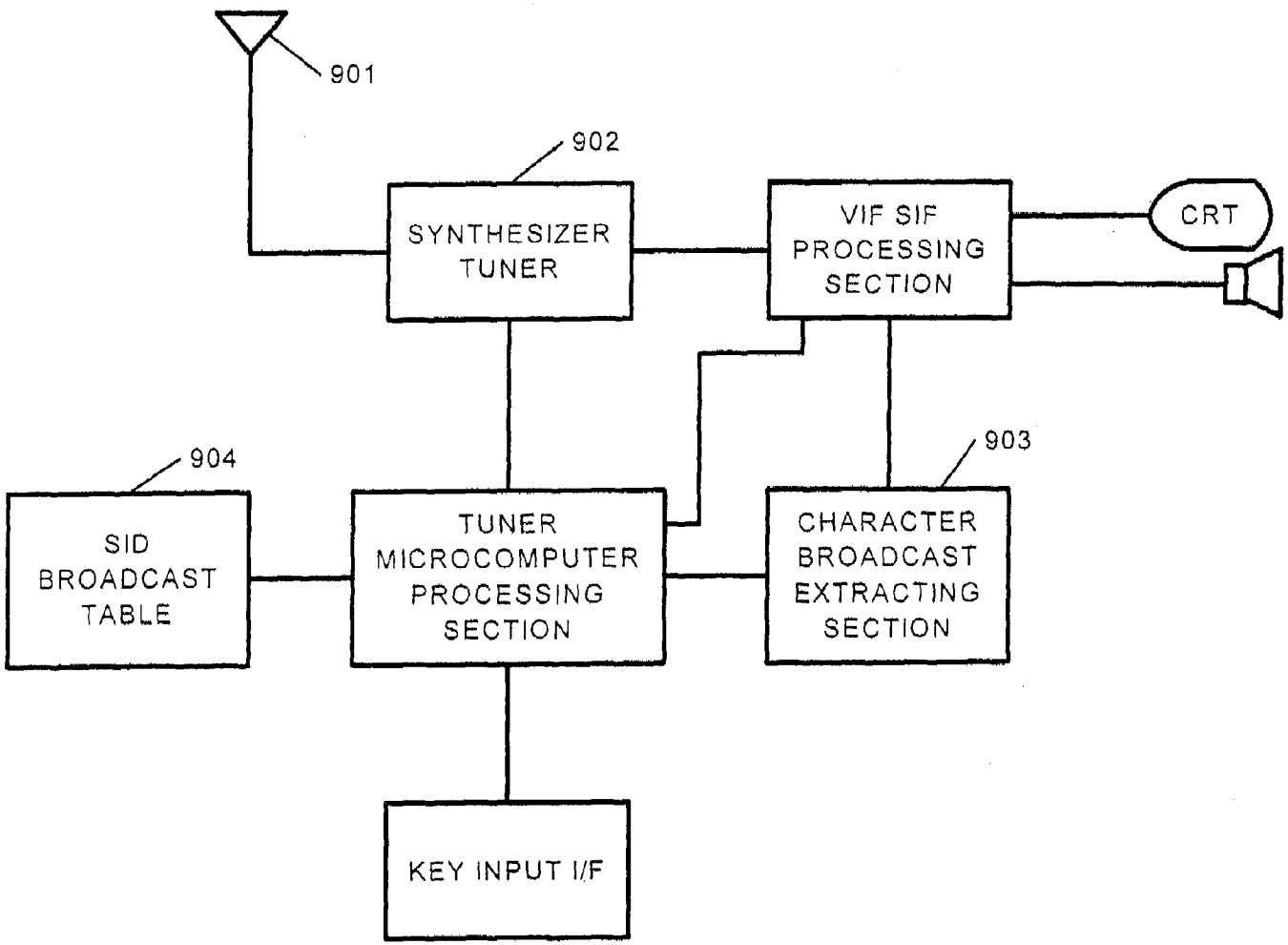
FIG.9 Prior Art
FIG. 9 is a diagram showing a configuration of a conventional media receiver.

FIG. 8 is a figure showing a format of a program table comprising a plurality of pieces of program information.

The program table has a program-information-count-N 801 field and a program-information 802 field.

The program-information-count-N 801 field shows how many program-information 802 fields this packet has (N in the shown case).

Also, the program-information 802 field comprises the fields of length 803, zone ID 814, program title 804, session number 805, multicast address 806, broadcast start time/end time 813, media information count M 817 and media information 808.

The length 803 represents a length of the program information 802 field. The zone ID 814 is identifying information for identifying a zone. The program title 804 is a title of program. The session number 805 is a number specifying the program and given not to overlap with another program. The multicast address 806 is a multicast address for sending each media. The broadcast start time/end time 813 is time information of a time to start and end the broadcast. The media-information-count M 807 represents the number of media-information 808 fields following this field. The media-information 808 field is a field separately describing the information about each media configuring program data.

The media information 808 field comprises the fields of length 809, media type 810, destination port number 811 and payload type 812. The length field 809 represents a length (byte length) of the media information 808 field overall. Meanwhile, the media type 810 is a field representing whether the media data is zapping data or program data, wherein, in the case of program data, it represents which media of the medias of moving image, sound, still image, text and layout information. For example, it is possible to represent any of zapping data and program data by the upper-order 1 bit and which media of the medias of moving image, sound, still image, text and layout information by the remaining bits. Also, the destination port number 811 shows to which destination port the media information represented by media information is to be sent. The receiver 320 is allowed to receive each media by participate in a multicast on the basis of the destination port number 811 and multicast address 806. Incidentally, in the case that multicast address differs based on each media, it is possible to cope with by describing a multicast address 806 in the media information 808 field instead of the program information 802 field. The payload type 812 is a payload type stored in a header part of each of media data. This is required for distinguishing the medias in the case that a plurality of medias are to be sent to the same multicast address and destination port. Where there is a premise that medias are to be sent to different destination ports, that is an unnecessary field.

Incidentally, FIG. 8 shows an example having program information in the number of N of program information 1 to program information N and media information in the number of M of media information 1 to media information M.

Although the above is the program table format, it is possible to apply various formats capable of transmitting program information without limited to the format form. Also, there is no need to send program information as a program table that the program information about all the programs in a zone have been gathered into one as shown in FIG. 8. Program information 802 may be sent separately based on each program.

Figure 4:
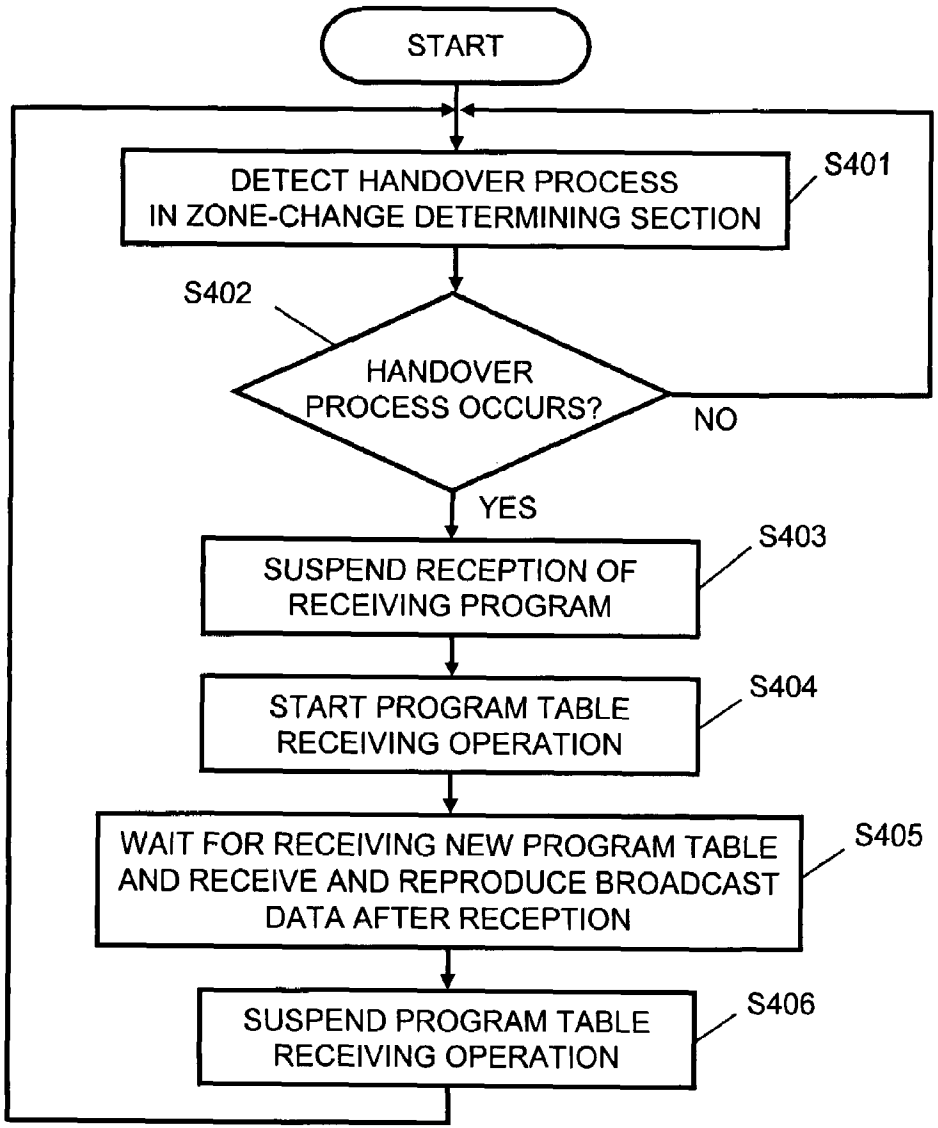
FIG. 4 is a flowchart showing a method to switch a reception program in embodiment 1 of the invention.

Next, explanation is made on a method that a reception program is switched by handover detection in order to correctly receive a broadcast program in a case that the media receiver 320 moves in a different zone and receive a broadcast program. FIG. 4 is a flowchart showing a method for switching a reception program by handover detection.

First, the zone-change determining section 307 for determining a zone change detects a presence or absence of handover process (step S401).

Next, the zone change determining section 307 checks whether a handover process has occurred or not (step S402). In the case of no occurrence, returning is to the step S401.

On the other hand, if occurred, the zone-change determining section 307 instructs the transmitting section 308 to suspend the reception of the program being currently viewed. In response to this, the transmitting section 308 suspends the reception (step S403).

Then, the transmitting section 308 starts to receive program information (step S404) and receives new program information. The program selecting section 309 reads a destination port number 811 for a program in a moved zone, on the basis of the new program information packetized by the depacketizing section 310, and notifies it to the transmitting section 308. The transmitting section 308 receives it and starts reception at a designated communication port (step S405).

Then, the reception of program information is suspended (step S406).

In this manner, entering a new zone is found by detecting a handover. By again receiving program information upon detection, eliminated is the necessity of always detecting program information. This can reduce the process of receiving program information in the receiver 330, making possible to relieve the load.

Also, the base-station selecting section 312 desirably notifies the zone-change determining section 307 of a new base station at a time of detecting that the base station greatest in radio intensity has moved continuously for a predetermined time from a so-far base station to another base station. This can prevent the transmitting section 308 from frequently receiving program information in an area unstable in radio-wave intensity change and switching the communication port.

Incidentally, the program reproduction in the step S405 may be automatically done in the media receiver 330 or by an instruction from the user. For example, in the case that a session number 805 of new program information is referred to detect the same program as the session number 805 of a program having been received immediately before, it is possible to receive the same program by automatically switching to the destination port number 811 of the same program.

The above algorithm can solve the problem that, where providing a program different based on each region, correct display of program is made impossible when the media receiver 330 has moved. In the case of not using the algorithm, because the receiver 330 carries out a reproducing process of program in the new zone on the basis of the program information acquired before, a broadcast content cannot be correctly decoded. Also, where there is difference in communication port used (e.g. expressed by IP address or port number), the broadcast data of a same program cannot be received.

Incidentally, this embodiment is effective for the utilization on a wireless network. In this case, it is possible to switch the program at high speed.

Second Exemplary Embodiment

Figure 7:
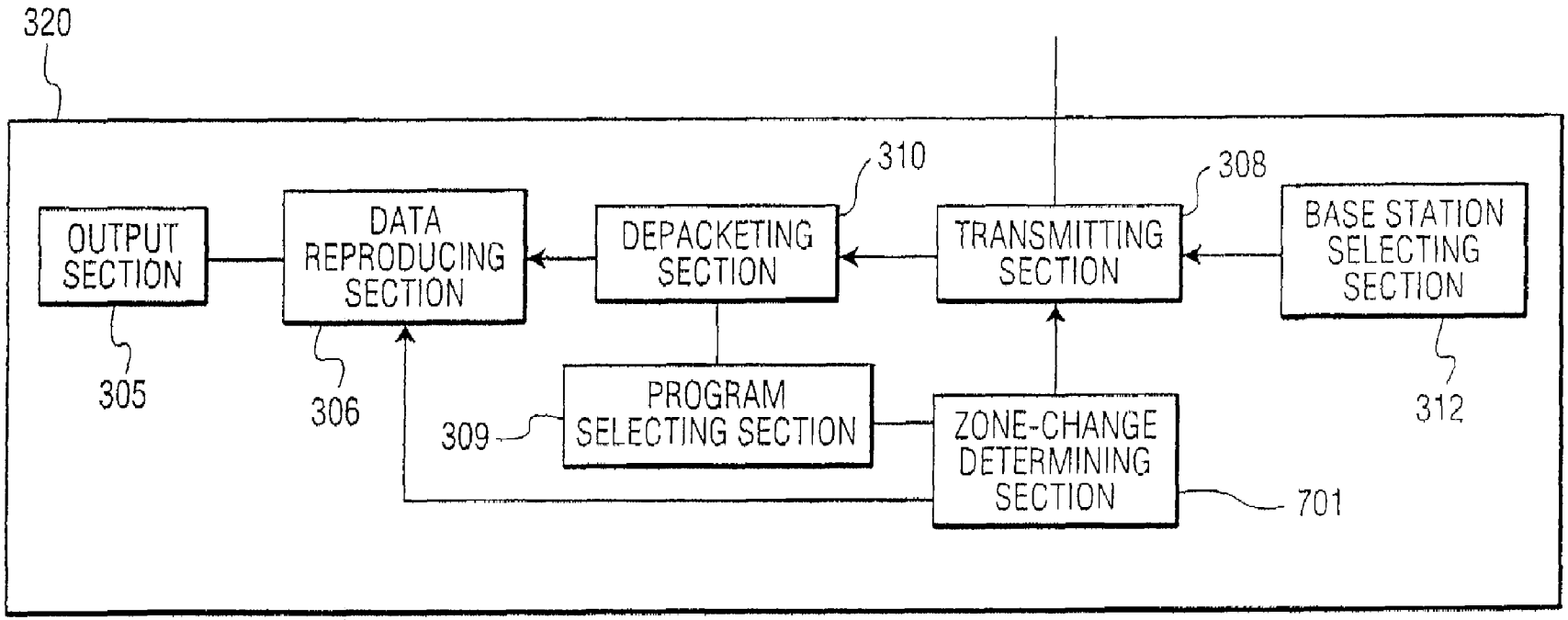
FIG. 7 is a diagram showing a configuration of a program distribution system in embodiment 2 of the invention.

FIG. 7 is a block diagram showing a configuration of a media receiver of a second embodiment of the invention.

In FIG. 7, there is a difference from the media receiver 330 in the first embodiment in that a zone-change determining section 701 is not notified of a new base station from a base station selecting section 312 and in that a data reproducing section 306 is directly notified of an instruction from the zone-change determining section 701.

The zone-change determining section 701 always monitors program information and detects a change of a zone ID 814 to thereby detect a zone change. However, in this embodiment, concerning program information, the program information of a program to be received only in the relevant zone is assumably received, regardless of the region, periodically (e.g. with a period of 5 seconds) at a same communication port.

Figure 6:
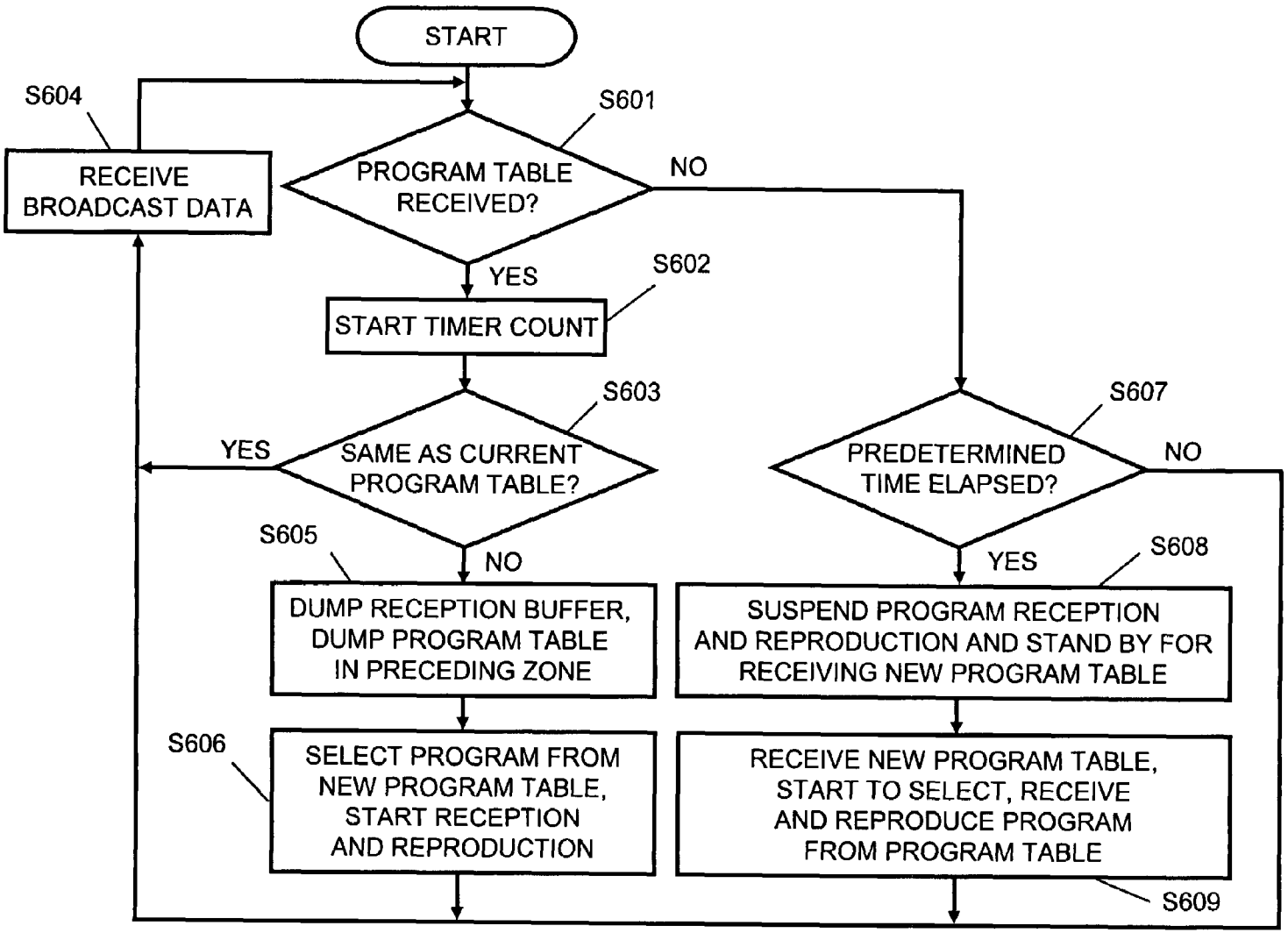
FIG. 6 is a flowchart showing a method to switch a reception program in embodiment 2 of the invention.

FIG. 6 is a flowchart showing a method that the media receiver 700 detects the zone change.

First, a transmitting section 308 checks whether having received new program information or not (step S601). In the case of a reception, a not-shown timer is started counting (step S602). The received program information is delivered to the zone-change determining section 701 through a program selecting section 309.

The zone-change determining section 701 makes a comparison with the program information received before (e.g. if SAP, distinction is by using an identification number) (step S603). In the case of the same program information, because the zone-change determining section 701 does not carry out any process at all, the transmitting section 308 continuously receives broadcast data at the same communication port. Received reception data is forwarded to the data reproducing section 306 through a depacketizing section 310. A data reproducing section 306 delivers the data from the reception buffer 501 shown in FIG. 5 to the data decoding section 502 and decodes it, outputting it to an output section 305. The output section 305 outputs decoded data onto a display or the like (step S604).

Meanwhile, in case the newest program information received in the step S603 is the same program information, the zone-change determining section 701 instructs the data reproducing section 306 to dump all the data of the reception buffer 501, and the data reproducing section 306 dumps them (step S605). Due to this, new program data when received next time can be reproduced immediately. Meanwhile, even if moved to another zone, the data possibly received at the communication port used in the former zone is dumped before detecting a zone change. Accordingly, it is possible to prevent the reproduction of erroneous data.

Then, the program selecting section 309 selects a program on the basis of the new program information and notifies the transmitting section 308 of a new destination port number 811 through the zone-change determining section 701. As a result, the data reproducing section 306 again starts reproduction (step S606). The transmitting section 308 makes a switching to a designated communication port and again starts reception (step S606). Thereafter, movement is to step S604.

Meanwhile, in the case of not receiving a program table in the step S601, the transmitting section 308 checks whether the timer has a count exceeded a predetermined threshold or not (step S607). In the case of not exceeding the threshold, movement is to step S604.

In the case of exceeding the threshold (i.e. in the case program information cannot be received for a constant time period), the transmitting section 308 determines that the receiver 700 is in an area where the program is impossible to receive, and suspends the reception and reproduction of program, thus being placed in standby until new program information is to be received (step S608).

Then, the transmitting section 308 if receiving new program information delivers it to the program selecting section 309. The program selecting section 309, if there is the same program as the program so far received, selects it from the new program information, and notifies the transmitting section 308 of a destination port number 811. The transmitting section 308 makes a switching to a designated communication port and starts to receive program data (step S609). Thereafter, movement is to step S604.

The above algorithm can solve the problem that, where providing programs different based on each region, correct display of program is made impossible when the media receiver 330 has moved.

This embodiment is characterized in that it can be used in a wired network, as well as a wireless network.

INDUSTRIAL APPLICABILITY

As in the above, the present invention is useful for a media receiver to receive programs while moving between regions in a situation that programs are provided at a communication port different based on each region, and suited for a user to correctly view a program even if he or she moves crossing regions.

The invention claimed is:

1. A media receiving method comprising:

a step of receiving program information representative of an outline and receiving condition of a program;

a step of receiving and reproducing the program on the basis of the program information;

a step of detecting that the program information has changed; and a step of determining whether the program is allowed for reproduction on the basis of the change of program information;

wherein, the program information includes a port identifier which identifies a communication port receiving the program, and the program is determined to be allowed for reproduction when the communication port receiving the program before the change of program information is the same as the communication port receiving the program after the change of program information.

2. A media receiving method according to claim 1, further comprising a step that, in a case of not allowed for reproduction, when there is difference in communication port but there is a same one as the program, switching is made to the communication port of after the change while, when there is not a same one as the program, reception is suspended.

3. A media receiving method comprising:

a step of receiving program information representative of an outline and receiving condition of a program;

a step of receiving and reproducing the program on the basis of the program information;

a base-station selecting step of measuring intensities of radio waves from a plurality of base stations, and selecting a base station to access on the basis of the radio wave intensity;

a change detection step of detecting that a base station to access has changed; and a suspension step of suspending a current reception of the program on the basis of the detection of a change;

a step of receiving new program information after the suspension step, wherein, the new program information includes the same program after the suspension that was received before the suspension.

4. A media receiving method according to claim 3, wherein the program information is received only in a predetermined time from a change of base station.

5. A media receiver comprising:

a transmitting section for receiving program information representative of an outline and receiving condition of a program, and further receiving the program on the basis of the program information; and a data reproducing section for reproducing the program; and a zone-change determining section for detecting a change of the program information;

whereby, when the zone-change determining section determines a change of program distribution area, in case a communication port for the program having been received before the change is not the same after the change, the data reproducing section is not allowed for reproduction.

6. A media receiver according to claim 5, wherein, in a case of being not allowed for reproduction, when there is difference in communication port but there is a same one as the program, switching is made by the transmitting section to the communication port of after the change while, when there is not a same one as the program, reception is suspended by the transmitting section.

7. A media receiver comprising:

a transmitting section for receiving program information representative of an outline and receiving condition of a program, and further receiving the program on the basis of the program information;

a data reproducing section for reproducing the program;

a base-station selecting section for measuring intensities of radio waves from a plurality of base stations, and selecting a base station to access on the basis of the radio wave intensity;

a zone-change detecting section for detecting that a base station to access has changed;

wherein, the transmitting section suspends a reception of the program based on a determination of a change of an area where the program is to be distributed made by the zone-change determining section;

the transmitting section receives new program information after the suspension, the new program information including the same program after the suspension that was received before the suspension.

8. A media receiver according to claim 7, wherein the program information includes information specifying a program name, a program start time, an end time, a reception port number and a program distribution area.

9. A media receiving method comprising:

a step of receiving program information representative of an outline and receiving condition of a program, the program information including information specifying at least one of a program name, a program start time, an end time, a reception port number and a program distribution area;

a step of receiving and reproducing the program on the basis of the program information;

a base-station selecting step of measuring intensities of radio waves from a plurality of base stations, and selecting a base station to access on the basis of the radio wave intensity;

a change detection step of detecting that a base station to access has changed; and a suspension step of suspending a current reception of the program on the basis of the detection of a change.

10. A media receiver comprising:

a transmitting section for receiving program information representative of an outline and receiving condition of a program, and further receiving the program on the basis of the program information, the program information including information specifying at least one of a program name, a program start time, an end time, a reception port number and a program distribution area;

a data reproducing section for reproducing the program;

a base-station selecting section for measuring intensities of radio waves from a plurality of base stations, and selecting a base station to access on the basis of the radio wave intensity;

a zone-change detecting section for detecting that a base station to access has changed;

whereby the transmitting section suspends a reception of the program based on a determination of a change of an area where the program is to be distributed made by the zone-change determining section.

* * * * *